US006272770B1

(12) United States Patent
Slutsky et al.

(10) Patent No.: US 6,272,770 B1
(45) Date of Patent: Aug. 14, 2001

(54) WASHER/DRYER COMBINATION WITH COLD WATER AND VACUUM

(75) Inventors: Dennis Slutsky, Providence, RI (US); Ricky D. Lerette, Stoughton, MA (US)

(73) Assignee: American Dryer Corporation, Fall River, MA (US)

( * ) Notice: Subject to any disclaimer, the term of this patent is extended or adjusted under 35 U.S.C. 154(b) by 0 days.

(21) Appl. No.: 09/460,794

(22) Filed: Dec. 15, 1999

(51) Int. Cl.[7] ..... F26B 11/02

(52) U.S. Cl. ..... 34/596; 34/599; 34/63; 34/90; 34/92; 34/215; 68/19.2; 68/20; 68/214

(58) Field of Search ..... 34/574, 62, 63, 34/90, 92, 596, 599, 215; 68/180, 19.2, 20, 214

(56) References Cited

U.S. PATENT DOCUMENTS

| | | | | |
|---|---|---|---|---|
| 3,718,485 | * | 2/1973 | Lankford | 426/438 |
| 4,112,590 | * | 9/1978 | Muller | 34/75 |
| 4,250,628 | | 2/1981 | Smith et al. | 34/260 |
| 4,257,173 | | 3/1981 | Smith | 34/92 |
| 4,348,817 | | 9/1982 | Bradshaw | 34/75 |
| 4,856,203 | * | 8/1989 | Wennerstrum | 34/68 |
| 4,882,851 | | 11/1989 | Wennerstrum et al. | 34/60 |
| 4,891,892 | | 1/1990 | Narang | 34/86 |
| 5,107,606 | * | 4/1992 | Tsubaki et al. | 34/596 |
| 5,122,633 | | 6/1992 | Moshammer et al. | 219/687 |
| 5,187,879 | | 2/1993 | Holst | 34/261 |
| 5,207,764 | * | 5/1993 | Akabane et al. | 68/20 |
| 5,301,379 | | 4/1994 | Schaal | 8/158 |
| 5,315,765 | | 5/1994 | Holst et al. | 34/260 |
| 5,357,771 | | 10/1994 | Schaal | 68/180 |
| 5,724,750 | | 3/1998 | Burress | 34/267 |
| 5,943,721 | * | 8/1999 | Lerette et al. | 8/158 |
| 6,154,978 | * | 12/2000 | Slutsky | 34/321 |

* cited by examiner

*Primary Examiner*—Pamela Wilson
(74) *Attorney, Agent, or Firm*—Connolly Bove Lodge & Hutz

(57) ABSTRACT

A cleaning apparatus having a sealable pressure vessel and an agitator for agitating an article, such as clothing, in a liquid within the vessel to remove contaminants from the article. A fluid system supplies fresh liquid to the vessel and drains used liquid from the vessel to separate excess contaminated from the article, a portion of the contaminated liquid being retained by the article after this separation. One or more heating elements are activatable to vaporize the retained liquid, and a vacuum system is activatable to reduce the pressure in the sealed vessel while the heating elements are activated, such that the boiling point of the retained liquid is substantially reduced from that at atmospheric pressure. The liquid may be plain, ozonated or carbonated water, or a mixture thereof, and may be cooled by a heat exchanger before being introduced into the sealed vessel. Agitation during washing and drying is minimized for use of the apparatus as an alternative to dry cleaning.

22 Claims, 1 Drawing Sheet

WASHER/DRYER COMBINATION WITH COLD WATER AND VACUUM

FIELD OF THE INVENTION

This invention relates to a combination apparatus for both washing and drying articles, such as clothing. More particularly, the invention relates to such a combined apparatus utilizing pressures below atmospheric and low temperature washing and rinsing fluids.

BACKGROUND OF THE INVENTION

Many clothes are sensitive to moderate or higher mechanical agitation and hot air drying, such that they cannot be washed in a conventional home washer or dried in a convention home dryer. Thus, conventional wisdom generally negates the use of water as a solvent for dry-clean only garments because of the shrinkage associated with conventional washing and drying machines. However, the problem with shrinkage is not the result of the water, but instead is the result of the mechanical action that takes place during normal washing machine cycles and of over heating of the clothing fibers during conventional drying machine cycles. Typical dryers expose garments to air temperatures in excess of 300° F. Typically fabrics start to breakdown at temperatures above 140° F. This fabric breakdown is the lint that is collected in every dryer.

For example, wool may be washed safely in cold water with mild agitation by hand, and then dried by hanging them in ambient air. If wool is exposed to the mechanical agitation of a conventional washer and the drying temperatures of a conventional dryer, it would be irrevocably damaged by mechanical impact and shrinkage. As a result, clothes made of wool or other delicate fibers are dry cleaned by immersion in non-polar hydrocarbon solvents to remove contaminants and are subsequently dried at temperatures that may be lower than the boiling point of water at atmospheric pressure. However, dry cleaning is expensive and hydrocarbon vapors resulting from the drying process may form explosive mixtures with air and are dangerous to personnel and to the environment.

In addition, conventional hot air dryers are inefficient because they do not transfer heat directly from the heat source to the water retained by the clothing. Instead, it is necessary to first heat the air to a relatively high temperature, and then use the hot air to heat the clothing and the walls and internal parts of the dryer, which then transfer the heat to the retained water to vaporize it. In addition, a lot of the heat input is lost in the hot air stream that leaves the drying chamber to transport away the resulting water vapor.

SUMMARY OF THE INVENTION

It is therefore an object of the present invention to clean dry-clean only garments and other delicate articles by utilizing water at low temperatures and with low mechanical agitation in both the washing process and the drying process, and to carry out both of these processes in the same vessel.

Another object of the invention is to provide a low temperature washer and dryer that virtually eliminates garment shrinkage associated with mechanical tumbling action during washing and drying, prevents the exposure of delicate garments to the high temperatures associated with hot air flow drying, thus prolonging the garment life, and carries out this washing and drying in a single chamber.

To accomplish this and other objects of the invention, a single washer/dryer vessel having a rotary tumbler therein is supplied with a cold liquid for one or more washing cycles, and is connected to a vacuum system during one or more drying cycles to remove the liquid from the washed articles at the low vaporization temperature achieved with the vacuum. A gentle tumbling action is provided intermittently during both the washing and drying cycles. Although, the articles are referred to below as clothing, the combined washing and drying apparatus may be used to clean other types of articles. While other polar liquids also may be used, the cleaning liquid is preferably water and may be city tap water, carbonated water, ozonated water or a combination thereof. Additives may also be injected into the water, such as detergents, sizing, fragrances and the like.

The combined washer/dryer apparatus may be connected to an existing water supply, and may include a chiller (heat exchanger) to provide cold water for one or more wash cycles. The chiller preferably provides cold water at a temperature in the range of 33° F. to 60° F. After the wash or rinse water is drained from the vessel, water retained by the articles may be heated, preferably directly, to facilitate the drying process. During the washing and drying cycles, the water temperature preferably does not exceed 130° F., more preferably 120° F.

The vacuum system connected to the washer/dryer vessel includes a vacuum pump, and a portion of the cold water from the chiller is preferably supplied to water cooled seals of the vacuum pump, which may be a liquid ring vacuum pump, to minimize water vaporization in and around the seals under the reduced pressure provided by the vacuum pump. An orifice plate may be used to control the flow of cold water to the vacuum pump seals.

A sediment filter may be placed in the water line to filter out any rust, dirt, or other contaminants that might otherwise enter the wash water and contaminant the clothes. A water softening device also may be placed in the water line if the water supply provides hard water, since hard water generally results in poor cleaning performance. Sediment filtration and water softening also increase the effectiveness of any detergent used by greatly reducing the interaction of any mineral salts with the detergent to form unwanted insoluble residues (soap scum).

The cleaning performance of the water also may be enhanced by using carbonated or ozonated water or some combination thereof. Ozonated water is an option to avoid the use of conventional chlorine bleach (sodium hypochlorite). Ozonated water uses Ozone ($O_3$) as the oxidizing agent instead of the Sodium Hypochlorite (NaOCl). Using Ozone eliminates the possibility of any excess Chlorine being released to the environment. Any excess Ozone quickly dissipates and forms regular Oxygen ($O_2$). Chilling the wash water also enhances the longevity of the Ozone as a bleach. In regular warm or hot water, the Ozone would quickly dissipate and become regular oxygen before acting on the garments. Cold water washing also adds the benefit of reduced utility costs. Carbonated water is an option to introduce $CO_2$ into the wash water. The $CO_2$ acts as a wetting agent allowing the water to reach garment stains that are not normally accessible by untreated water. The carbonic acid formed by the $CO_2$ in carbonated water also combines with any mineral salts that may be in the water or in the clothing to form sodium carbonate, a known cleaning agent. A detergent or surfactant may be injected into the water before or after it is introduced into the washer/dryer vessel. Other additives may also be injected such as sizing and fragrances.

A water pump may be provided to supplement city water pressure and for draining the vessel between wash and rinse cycles and between the last wash or rinse cycle and the first drying cycle. The amount of water pumped to the washer/dryer vessel depends on the water level appropriate for the amount of clothes loaded inside. The detergents and other additives, if any, are specifically designed for washing with cold water and may be added to the vessel either in admixture with the fill water or separately.

The liquid level may be controlled by a liquid level transmitter on the washer/dryer vessel or may be controlled using a load cell. A liquid level transmitter will control the amount of water based on the actual height of water within the vessel. The load cell may be used to fill the vessel based on the weight of water introduced. For example, if the operator wishes to use exactly 15 gallons of water per wash load (detergents may be based on a per gallon of water basis), that water load can be programmed in and the load cell will initiate a signal to shut off the incoming water supply once that water load is reached. At room temperature, water weighs approximately 8.3 lbs. per gallon. So in this case, the load cell would signal the water to shut off after seeing a weight increase of about 125 lbs.

Once the desired liquid level is achieved, ultrasonic transducers are used to sonically clean the garments. The level of ultrasonic power may range from 500 to 1,500 watts for a 35 lbs. load of garments. Power control may be made adjustable to compensate for varying size laundry loads as the amount of ultrasonic power required is directly related to the amount of water in the washer. Frequency ranges for the ultrasonic cleaning may range from 18 to 120 kHz, with a preferred range of 35–50 kHz.

The apparatus preferably includes an apertured tumbler into which the clothes or other articles are placed within the washer/dryer vessel, and the tumbler is preferably rotated by a variable frequency drive motor that is controlled by a microprocessor to simulate hand washing of the articles. After the wash water is drained, this is preferably followed by one, more preferably two, cold water rinses where a detergent has been added to the wash water. However, the detergent may be omitted where the wash water is carbonated or ozonated, and in these instances, some or all of the rinse cycles also may be omitted.

Where the articles are clothing and made of agitation sensitive fibers, the agitation provided by the tumbler is designed to be very gentle so as to have negligible mechanical effects on the clothing. For cleaning agitation sensitive fabrics, the load preferably is rotated intermittently (about once every 30 seconds) by the variable frequency drive motor for both the wash and rinse cycles. During the time the garments are being washed, the sonic cleaning continues while the tumbler is rotated and at rest. This process preferably is initially set for 5 minutes but is operator adjustable. The wash water is then drained and preferably followed by two rinse cycles of approximately 2 minutes each, which is also operator adjustable, where a detergent has been used. For ozonated wash water option, the number and length of the rinse cycles are adjustable. This is because the reduction in the amount of chemicals used during ozonated washing will also reduce the amount of rinsing required, possible to the point of not needed a rinse cycle. Rinse water and wash water temperatures preferably will be at about 60° F. Another option is that sizing or starch may be added during one or more of these cycles if desired by the operator.

At the end of the wash cycle where no rinse cycle is used or at the end of the last rinse cycle where used, the water is drained from the vessel and the tumbler optionally is rotated for a low speed water extracting cycle. This low speed spin cycle simulates hand pressing of the clothing to remove excess water. The rotational speed of the tumbler during the optional mild extract cycle is dependent on the type of garments being washed. Delicates may use no extract whereas more durable garments may use the full extract speed, the speed being variable to provide a centrifugal force on the garments preferably in the range of 1 to 100 g's, more preferably 40 to 60 g's. After this extract cycle, the load cell records the wet weight of the garments.

At the end of the low speed water extraction, the vacuum pump is turned on. Once the pressure has reached 100 torr, microwave transmitters or other supplemental heating devices are turned on to heat up the water molecules retained in the wash load. The supplemental heating is necessary to counteract the evaporative cooling and to maintain the water temperature above its reduced pressure boiling point. During this process, the tumbler may continue rotating intermittently (about once every thirty seconds) to periodically tumble the garments. The heating devices may be any types capable of delivering heat directly to the retained water, such as radiant heaters or microwave transmitters. A microwave device is preferred because microwaves directly heat up the water molecules within the clothing while adding little heat to the lower density clothing, and therefore provides a more efficient heating process.

When the vacuum pump is running, the vacuum in the chamber of the washer/dryer vessel is quickly reduced to at least 100 torr, preferably to about 50 torr. At about 50 torr, water is vaporized at a boiling point of about 100° F. The heating device(s) forming part of the apparatus may be controlled by a microprocessor in combination with one or more temperature transmitters that sense the temperature of the vessel chamber, so that it does not exceed a maximum temperature of preferably about 130° F., more preferably about 120° F. These maximum temperatures are based on studies that indicate that temperature sensitive fabrics do not tend to degrade significantly from heat exposure until their temperature is above about 150° F.

The drying cycle ends when the level of retained moisture in the clothing as measured by the load cell reaches a percentage of its original value as previously set by the operator of the apparatus. When the type of fibers in the clothing is delicate, the drying process may end once the retained moisture reaches a level of about 10% of the original saturation value. If the clothing is not that delicate, the drying process may be left on until a saturation of about 2% is reached. The retained moisture level in the clothing also may be measured by a direct sensing method using electrodes to determine water content by measuring the electrical resistance of the clothing fabric.

BRIEF DESCRIPTION OF THE DRAWING

The invention, both as to its structure and operation, may be further understood by reference to the detailed description below taken in conjunction with the accompanying drawing (FIG. 1), which is a schematic diagram of the fluid and electrical systems and of the major components of the invention.

DETAILED DESCRIPTION OF THE INVENTION

Figure 1:
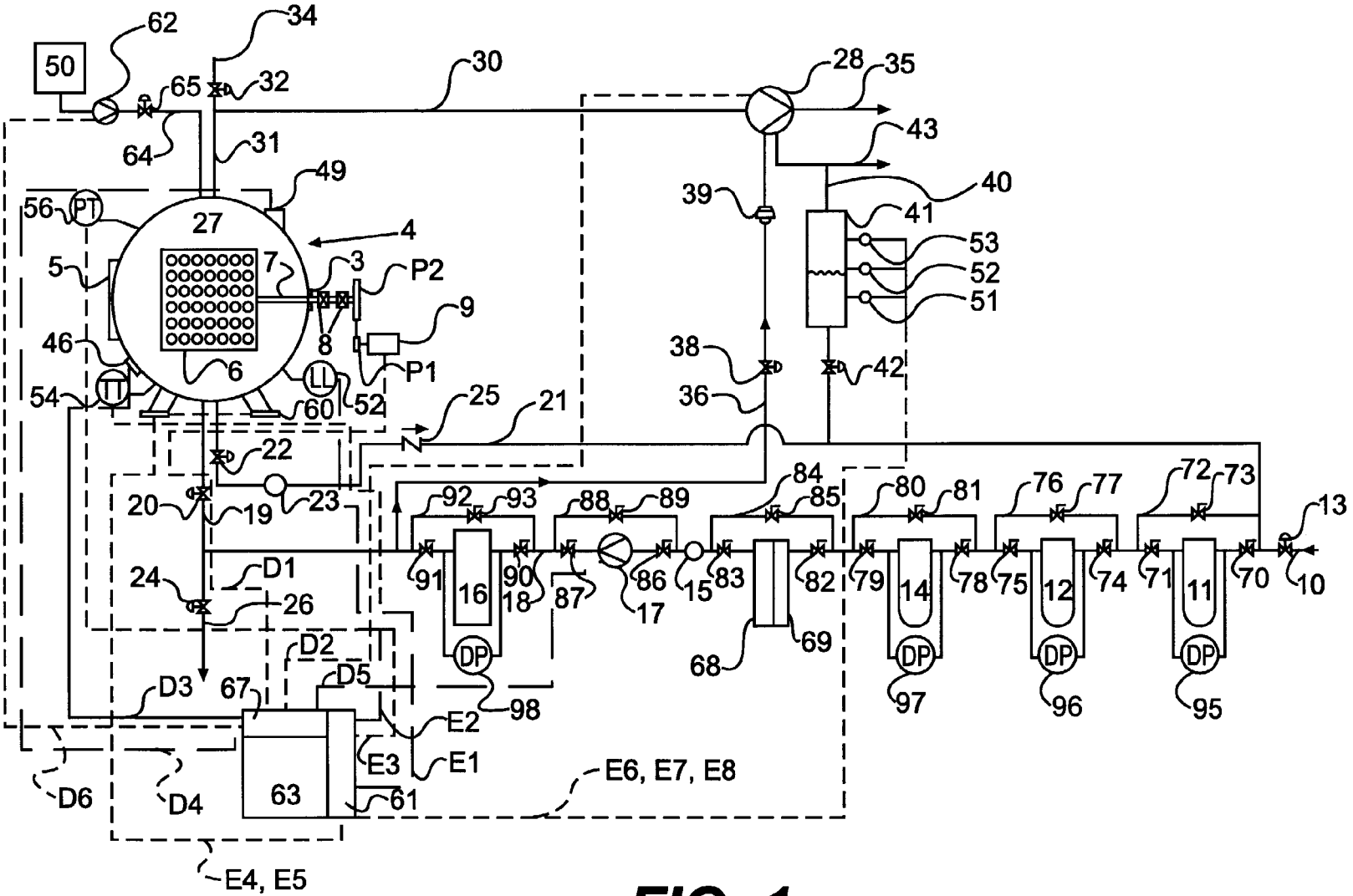

The washer/dryer combination apparatus of the present invention comprises a washer/dryer vessel, generally designated 4, having a front door 5 for sealably closing an opening through which clothing or other articles may be placed in a tumbler 6 rotated by a shaft 7, which is rotatably mounted in a bearing set 8. Shaft 7 passes through a mechanical seal 3 and is driven in rotation by a variable frequency drive motor 9 via drive pulleys P1 and P2. The vessel 4 is supplied with city water via a supply line or conduit 10 containing a solenoid valve 13. Water from line 10 flows through a sediment filter 11, a water softener device 12, a carbon filter 14, an optional carbonated water system 68, an optional ozonated water system 69, and a flow rate indicator 15, and is inputted to a water pump 17. The output of water pump 17 is inputted to a chiller 16 (heat exchanger) by a connecting line 18. The output of the chiller 16 is inputted to the vessel 4 by a connecting line 19 containing a solenoid valve 20.

A water outlet of the vessel 4 is connected to the water supply line 10 via a recycle line 21 containing a solenoid valve 22 and a sight glass 23. Pump 17 may be used in filling vessel 4 and also to recirculate wash water or rinse water through the vessel 4 and line 21, in which case solenoid valves 13 and 24 are closed and solenoid valves 20 and 22 are opened. A check valve 25 in line 21 allows the addition of make-up water from supply line 10 by preventing reverse flow through recyle line 21 during recirculation. For draining the vessel 4, the line 19 is connected to a discharge line 26 containing a solenoid valve 24. To drain vessel 4, solenoid valves 22 and 13 are closed and solenoid valves 20 and 24 are opened while water pump 17 is turned off.

When the front door 5 is closed, the washer/dryer vessel 4 is sealed from atmospheric pressure. The vessel 4 also may be sealed from water lines 19 and 20 by the closure of solenoid valves 20 and 22. The chamber 27 of vessel 4 may then be placed under vacuum by operation of a vacuum pump 28 connected to the vapor space of chamber 27 by a suction line 30 and a vapor line 31. Pump 28 discharges to a drain through an exhaust line 35. Alternatively, the vessel chamber 27 may be vented to atmosphere via a vent line 34 containing a solenoid vent valve 32, which is opened for venting and closed for operation of the vacuum pump 28.

The vacuum pump 28 is preferably of the liquid seal ring type having water cooled seals, and a portion of the cold water from chiller 16 is supplied to these seals via a line 36 containing a solenoid valve 38, and an orifice 39. After passing through the seals of the vacuum pump, the seal water is discharged to drain via a line 43 or optionally recirculated to recyle line 21 via a seal water line 40 containing a water tank 41 and a solenoid valve 42. Valve 42 may be controlled in response to the water level in tank 41 as detected by level sensors S1, S2 and S3.

Although sufficient agitation of the clothing may be provided by the tumbler 6 alone, additional agitation to aid in the release of contaminants from the clothing is preferably provided by one or more ultrasonic transducers 46. After the vessel 4 has been drained of free water (excess water not retained by clothing) via lines 19 and 26, the vacuum pump 28 is operated to provide a vacuum in this vessel. While under the vacuum, the residual or retained water in the clothing is preferably heated by microwave radiation from one or more microwave transmitters 49, each comprising a magnetron and a wave guide. In combination therewith, or alternatively, the body of the tumbler 6 may be heated by electrical resistance, infrared radiation, or hot liquid conduction for direct heating of the clothing and the water retained therein.

The degree to which retained water has been removed from the clothing by vacuum in combination with the direct heating is preferably determined by a pair of load cells 58 and 60, which are positioned to measure the weight of the loaded vessel 4 to determine the weight of the clothing before water is added to the vessel 4 and after free water is separated from the clothing and drained from the vessel 4, the difference being the weight of water retained in the clothing at the commencement of the drying cycle.

Within the vessel 4, the liquid level is measured by a liquid level transmitter 52, the temperature is measured by a temperature transmitter 54, and the pressure is measured by a pressure transmitter 56. The respective outputs E1, E2 and E3 of all of these transmitters are inputted into the encoder 61 of a microprocessor 63. Also inputted to the encoder 61 are the respective outputs E4, E5, E6, E7 and E8 from the load cells 58 and 60 and the seal water level sensors S1, S2 and S3. Outputted from the microprocessor 63 through a decoder 67 are the respective outputs D1, D2, D3 and D4 for controlling the variable frequency drive motor 9, the vacuum pump 28, the ultrasonic transducer 46, and the microwave transmitter 49. Respective outputs D5 and D6 from the decoder 67 are also input to the water pump 17 for supplying wash water and rinse water to, and recycling these waters from, the vessel 4, and to an additive metering pump 62 for injecting any desired treatment chemicals from a mixing and/or storage tank 50 into the wash water or rinse water. In addition, outputs from the decoder 67 are inputted to the various solenoid valves described herein, although these outputs and inputs have not been illustrated in FIG. 1 for clarity of this drawing.

In order to enhance to cleaning action of the wash water, one or more detergents may be added using the additive metering pump 62 that is connected directly to the vessel 4 via an additive line 64 containing a solenoid valve 65. In addition to detergent, the metering pump 62 may be used to introduce into the wash water other fabric treating chemicals, such as sizing, fragrances and the like. As previously described, the wash water may comprise city tap water that is treated with other chemicals to remove minerals in a water softener 12, is filtered to remove particulates in a sediment filter 13, and also may be filtered in a carbon filter 14 to remove odors and/or dyes bleeding from the clothing.

Each of the components connected between the supply line 10 and the vessel inlet/outlet line 19 may be provided with a pair of isolation valves and a bypass line containing a stop valve so that these components may be isolated for service and/or replacement without interrupting operation of the washer/dryer unit. Thus, sediment filter 11 is provided with isolation valves 70 and 71 and a bypass line 72 containing a stop valve 73, water softener 12 is provided with isolation valves 74 and 75 and a bypass line 76 containing a stop valve 77, carbon filter 14 is provided with isolation valves 78 and 79 and a bypass line 80 containing a stop valve 81, the optional water systems 68 and 69 are provided with isolation valves 82 and 83 and a bypass line 84 containing a stop valve 85, water pump 17 is provided with isolation valves 86 and 87 and a bypass line 88 containing a stop valve 89, and chiller 16 is provided with isolation valves 90 and 91 and a bypass line 92 containing a stop valve 93. The sediment filter, water softener, carbon filter and chiller are also preferably provided with differential pressure indicators 95, 96, 97 and 98, respectively, for indicating when these components need to be serviced or replaced.

Other sources of water, such as specially treated water, may be used in place of or combined with city tap water as illustrated by the carbonated water and ozonated water systems 68 and 69. Either carbonated water or ozonated water or a combination thereof may be used exclusively as the wash water, or one or more of these specially treated waters may be mixed with tap water to provide the wash water fed to the vessel 4. If the specialty water sources 68 and 69 do not include a chiller, their outputs are introduced into the feed water ahead of the chiller 16 as shown in FIG. 1. On the other hand, if the output of each specialty water source is already chilled, this output may be fed directly to the water line 19 via a separate feed line (not shown).

Operation of the washer/dryer unit will now be described with respect to the cleaning of clothing, specifically dry clean only garments, although the unit may be used to clean other types of clothing or articles. The garments to be cleaned are placed into the tumbler 6 through an open front door 5, and the door 5 is enclosed to seal the vessel 4 from ambient conditions. However, during the wash cycle and any rinse cycles, the internal chamber 27 preferably remains in communication with the atmosphere via the vent line 34 by keeping solenoid valve 32 open. Prior to the garments being placed in the tumbler 6, any appropriate spot removal chemicals and techniques may be applied thereto. Once the door 5 is closed, the load cells 58 and 60 record the initial weight of the dry garments in a storage medium of the microprocessor 63.

The chamber 27 is then filled with wash water, which may contain detergent and/or other additives as previously described. If a substantial portion of the wash water is carbonated or ozonated, the amount of detergent needed may be reduced significantly. If a major portion of the wash water is either carbonated or ozonated or both, the need for detergent may be entirely eliminated, at least in some applications.

Once the desired liquid level is achieved, which depends on the garment loading of the tumbler, the ultrasonic transducer is activated by the microprocessor to sonically clean the garments. During ultrasonic cleaning, the wash load is preferably rotated about once every 30 seconds via the variable frequency drive motor 9. The desired length of this wash cycle is inputted into the microprocessor 63 by the operator, and for example, may be an initially set for 5 minutes.

After the wash cycle, the water is drained and, if detergent was used, this is followed by two rinse cycles, which may be at the same water level as the wash cycle or at a different water level. The desired length of the rinse cycles may also be entered into the microprocessor 63, such as two minutes each for example. If the wash water contained a substantial portion or a major portion of ozonated or carbonated water, there may be only one rinse cycle or no rinse cycles, respectively. The temperature of both the wash water and the rinse water is preferably about 60° F.

After the free wash water, and free rinse water if used, is drained off through valve 20, line 19, valve 24 and line 26, the garments may be subjected to a mild water extracting cycle to reduce the amount of retained water, which is optional depending on the operator input to the microprocessor 63. This free water extract cycle is considered "mild" when the rotation of tumbler 6 by the motor 9 does not subject the garments to more than about 50 g's, preferably about 40 g's or less, more preferably about 35 g's or less.

After the extract cycle, the wet weight of the garments is then recorded in the storage medium of the microprocessor 63 by the load cells 58 and 60. Following this recordation, the solenoid valve 32 is closed to isolate the chamber 27 and the vacuum system from ambient pressure, and the vacuum pump 28 is started by the microprocessor. Once the chamber pressure, as measured by the pressure transmitter 56, has been reduced to 100 torr, the microwave transmitter 49 is activated by the microprocessor to directly heat up the water molecules retained in the clothing load. The vacuum pump continues to operate until the chamber pressure has been further reduced, preferably to about 40 to 60 torr, more preferably about 45 to 55 torr, and most preferably about 50 torr, at which point the vacuum pump 28 is cycled or otherwise operated to maintain the desired level of vacuum within chamber 11. At a chamber pressure of about S0 torr, water begins to boil at about 100° F. instead of its standard boiling temperature of 212° F.

During this drying cycle, the tumbler 6 may be periodically rotated for at least one revolution at preselected intervals, preferably about once every 20 to 30 seconds, to facilitate drying of the garments. The microwave transmitters are preferably controlled by the microprocessor 63 so that their direct heat input to the water retained in the garments is such that at no time does the temperature of the retained water exceed a maximum temperature of preferably 130° F., more preferably 120° F.

The drying process ends once the load cells 58 and 60 determine that the weight of the clothing has reached a desired percentage of the original weight of the wet clothing (the saturation value). If the garments are of a delicate type, the drying process may end once the weight thereof has reached a level of about 10% of the saturation value. If the garments are not that delicate, the drying process may be left on until a lower percentage is reached, such as about 2% of the saturation value.

A number of modifications, changes and alterations to the washer/dryer unit and its associated systems are possible without departing from the scope of the present invention. For example, a tumbler body made of heat conducting material may be heated internally by radiant heat, electrical resistance heat or hot fluid conduction, and thereby directly heat water retained within the articles inside the tumbler 6. Thus, direct heating of the water contemplates either microwave heating of the water molecules or direct heat transfer to the water molecules by a heated component or element, and is distinguished from drying with heated air. Another possible modification would be to eliminate the water pump 17 by using city water pressure to fill the vessel 4 and a pressurized air system to pressurize vessel chamber 11 above atmospheric so as to discharge the used wash and/or rinse water to the discharge line 26. Other types of components may be also be used for the water chiller and vacuum pumps, the tumbler drive motor, the water filters and the water softener. The sediment filter and the water softener also may be eliminated, depending on the quality of tap water available to the washer/dryer unit.

Accordingly, many modifications, changes and alterations to the invention will occur to those skilled in the art when they learn of the disclosure presented herein. The scope of the invention therefore is not limited to the specific examples described above, but instead is defined by the numbered claims set forth below.

What is claimed is:

1. An article cleaning apparatus comprising:

a pressure vessel having an opening for introducing the article into said vessel, and a door member for closing and sealing said opening to provide a wash chamber maintainable at a pressure other than atmospheric pressure;

agitation means for agitating the article in contact with a liquid while said article and said liquid are contained in said vessel to cause said liquid to remove contaminants from said article;

drain means for draining from said vessel said contaminated liquid to separate excess liquid from said article, said article retaining a portion of said liquid after said excess liquid separation;

heating means activatable to directly heat said retained liquid to separate it from said article by vaporization at the boiling point of said liquid; and, vacuum means for reducing the pressure in said vessel while it is sealed and said heating means is activated, said pressure reduction causing the boiling point at which said liquid vaporizes to be reduced from its boiling point at atmospheric pressure.

2. A cleaning apparatus according to claim 1 further comprising liquid supply means for introducing said liquid into said vessel while said door member is closed.

3. A cleaning apparatus according to claim 2 wherein said liquid supply means comprises heat exchange means for cooling said liquid below its ambient temperature before it is introduced into said vessel.

4. A cleaning apparatus according to claim 3 wherein said vacuum means comprises a vacuum pump having at least one liquid cooled vacuum seal, and said liquid supply means further comprises means for supplying a portion of said cooled liquid to said vacuum seal.

5. A cleaning apparatus according to claim 2 wherein said liquid supply means comprises filter means for removing a dye from said introduced liquid, and recirculation means for recirculating at least a portion of said introduced liquid through said filter means and back into said vessel.

6. A cleaning apparatus according to claim 2 wherein said liquid is water and said liquid supply means comprises water softening means.

7. A cleaning apparatus according claim 2 wherein said liquid is water, and wherein said liquid supply means includes means for providing carbonated water as at least a portion of the water introduced into said vessel.

8. A cleaning apparatus according to claim 2 wherein said liquid is water, and wherein said liquid supply means includes means for providing ozonated water as at least a portion of the water introduced into said vessel.

9. A cleaning apparatus according to claim 2 wherein said liquid supply means comprises means for injecting an additive into the liquid introduced into said vessel.

10. A cleaning apparatus according to claim 9 wherein said additive is a detergent composition.

11. A cleaning apparatus according to claim 9 wherein said additive is a sizing composition.

12. A cleaning apparatus according to claim 9 wherein said additive is a fragrant composition.

13. A cleaning apparatus according to claim 2 wherein said liquid is water and said liquid supply means comprises sediment filtering means.

14. A cleaning apparatus according to claim 2 wherein said liquid is water and said liquid supply means comprises water softening means and sediment filtering means.

15. A cleaning apparatus according to claim 1 wherein said heating means comprises at least one microwave transmitter.

16. A cleaning apparatus according to claim 15 further comprising load detection means for deactivating said microwave transmitter in response to a preselected decrease in the weight of liquid retained by said article.

17. A cleaning apparatus according to claim 1 further comprising load detection means for deactivating said heating means in response to a preselected decrease in the weight of liquid retained by said article.

18. A cleaning apparatus according to claim 1 wherein said agitation means comprises tumbler means for tumbling said article in contact in said liquid, drive means for rotating said tumbler means to cause said article tumbling, and control means for controlling said drive means so that said tumbler may be rotated intermittently.

19. A cleaning apparatus according to claim 18 wherein said agitation means further comprises at least one ultrasonic transducer.

20. A cleaning apparatus according to claim 1 wherein said agitation means comprises tumbler means including a basket having a generally cylindrical wall around a central axis and apertures in said wall for passing said liquid therethrough, and drive means for rotating said basket about its central axis; and wherein said apparatus further comprises control means for causing said drive means to intermittently rotate said basket, said control means and said rotating basket being arranged to tumble said article in contact with said liquid to remove contaminants and to tumble said article when said heating and vacuum means are activated to facilitate its said separation from retained liquid.

21. A cleaning apparatus according to claim 20 wherein said agitation means further comprises at least one ultrasonic transducer.

22. A cleaning apparatus according to claim 20 wherein said liquid is water; and wherein said apparatus further comprises water supply means for introducing said water into said vessel while said door member is closed, filter means for removing a dye from said introduced water, and recirculation means for recirculating at least a portion of said introduced water through said filter means and back into said vessel.

* * * * *